US007687950B2

(12) United States Patent
Kuckes

(10) Patent No.: US 7,687,950 B2
(45) Date of Patent: Mar. 30, 2010

(54) DRILLSTRING ALTERNATOR

(75) Inventor: Arthur F. Kuckes, Ithaca, NY (US)

(73) Assignee: Vector Magnetics LLC, Ithaca, NY (US)

( * ) Notice: Subject to any disclaimer, the term of this patent is extended or adjusted under 35 U.S.C. 154(b) by 293 days.

(21) Appl. No.: 11/987,055

(22) Filed: Nov. 27, 2007

(65) Prior Publication Data

US 2009/0133867 A1 May 28, 2009

(51) Int. Cl.
*E21B 4/04* (2006.01)
*H02K 21/26* (2006.01)
*H02K 5/132* (2006.01)

(52) U.S. Cl. ..... 310/87; 310/117; 310/155; 310/168; 175/104

(58) Field of Classification Search ..... 310/87, 310/155, 166, 168, 117; 175/104
See application file for complete search history.

(56) References Cited

U.S. PATENT DOCUMENTS 2,890,019 A * 6/1959 Arps ..... 175/50
3,036,645 A * 5/1962 Rowley ..... 175/93
4,103,194 A * 7/1978 Anderson ..... 310/68 D
5,248,896 A * 9/1993 Forrest ..... 290/1 R
5,517,464 A * 5/1996 Lerner et al. ..... 367/84
5,685,379 A * 11/1997 Barr et al. ..... 175/61
6,367,565 B1 * 4/2002 Hall ..... 175/50

(Continued)

FOREIGN PATENT DOCUMENTS

DE 19706371 * 8/1998

(Continued)

*Primary Examiner*—Burton Mullins
(74) *Attorney, Agent, or Firm*—Jones, Tullar & Cooper, PC

(57) ABSTRACT

A downhole source of electrical power for drilling tools is driven by the rotation of a drillstring or, if the drillstring is not rotating, by the rotation of a drilling sub. The source consists of an alternator having a rotor made up of a series of coils that are mounted on, and spaced around the circumference of, a rotating drilling sub, and a stator made up of a multiplicity of permanent magnets also spaced around the circumference of the drilling sub. The stator is mounted on the drilling sub by means of bearings and incorporates a counterweight that holds the rotor relatively stationary with respect to the sub and with respect to the coils, so that rotation of the sub, either by rotation of the drillstring or by rotation of a drill motor in the drilling sub, produces relative rotation of the rotor and stator to generate an AC electrical output. The rotor and stator surround an axial fluid passage through the center of the alternator so that they do not impede the flow of the drilling fluid, and the motor is totally sealed to prevent damage to the bearings. The alternator stator is an annular permanent magnet structure which surrounds the drilling axis, and which may include two sets of rare earth disc magnets spaced axially to form an axial gap, with the counterweight holding the magnets stationary with respect to the alternator coils. The coil structure is also annular and also surrounds the drilling axis, with the coil structure preferably including two sets of offset coils positioned to rotate in the gap between the permanent magnets. The two sets of coils make up a two-phase system; if desired, a single set of coils may be used to provide a single-phase system.

11 Claims, 3 Drawing Sheets

U.S. PATENT DOCUMENTS

| | | | | |
|---|---|---|---|---|
| 7,141,901 | B2 * | 11/2006 | Spring | 310/77 |
| 7,434,634 | B1 * | 10/2008 | Hall et al. | 175/107 |
| 2008/0142264 | A1 * | 6/2008 | Hall et al. | 175/45 |
| 2008/0203734 | A1 * | 8/2008 | Grimes et al. | 290/40 R |

FOREIGN PATENT DOCUMENTS

| | | | |
|---|---|---|---|
| GB | 2230288 | * | 10/1990 |

* cited by examiner

DRILLSTRING ALTERNATOR

BACKGROUND OF THE INVENTION

The present invention relates, in general, to systems and apparatus for generating electrical power within a borehole, and, more particularly, to a downhole alternator for generating power upon rotation of the portion of the drillstring in which it is mounted.

When drilling boreholes in the earth's crust for such purposes as oil and gas exploration, tunneling under obstacles for the placement of cables, or for a wide variety of other purposes, it is generally necessary to provide drilling tools in the drillstring which incorporate various sensors and control instrumentation for guiding the direction of drilling, detecting the conditions at the drill head, and transmitting data and control signals between the drill head and the earth's surface. Such downhole instrumentation requires a reliable source of electrical power for operation, and over the years a great deal of effort has been put into developing such a source. For example, attempts have been made to supply electrical power to downhole instruments from a surface source, as by way of wires or cables extending the length of the drillstring. However, the use of such wires or cables in rotating drillstrings has been unsatisfactory, because of the difficulty in maintaining secure connections at each joint in the drillstring.

Downhole battery supplies have generally replaced surface power sources for downhole circuitry, but they, too, have limitations in that they have a limited life, requiring periodic replacement that results in costly down time for the drilling operation.

Various attempts have been made to overcome these problems by introducing a downhole electrical generator to either recharge batteries or to provide power directly to the downhole instruments. Such generators have been powered by the flow of drilling fluid in the borehole, but difficulties have been encountered in maintaining reliable operation in the hostile environment of downhole drilling. The abrasive, high-pressure drilling fluid flowing through and around the drillstring is destructive of generator moving parts, and is particularly hard on rotating seals, while the placement of such generators in the flow path of the drilling fluid interferes with the flow and prevents access to the drillstring below the generator location.

SUMMARY OF THE INVENTION

The present invention overcomes the foregoing problems by providing a downhole source of electrical power for drilling tools that is driven by the rotation of the drillstring or, if the drillstring is not rotating, by the rotation of the drilling sub, which is the portion of the drillstring that carries the drill bit. The source consists of an alternator having a rotor made up of a series of coils that are mounted on, and spaced around the circumference of, a rotating drilling sub, and a stator made up of a multiplicity of permanent magnets also spaced around the circumference of the drilling sub. The stator is mounted on the drilling sub by means of bearings and incorporates a counterweight that holds the rotor relatively stationary with respect to the sub and with respect to the coils, so that rotation of the sub, either by rotation of the drillstring or by rotation of a drill motor in the drilling sub, produces relative rotation of the rotor and stator to generate an AC electrical output. The rotor and stator surround an axial fluid passage through the center of the alternator so that they do not impede the flow of the drilling fluid, and the motor is totally sealed to prevent damage to the bearings.

The present alternator structure requires inclination of the borehole to enable the counterweight to function to produce relative rotation of the rotor and the stator, but vertical boreholes are rare, so this is generally not an issue. The present invention is extremely valuable for directional drilling, since that type of drilling requires reliable downhole instrumentation. The alternator of the present invention relies on rotation of that portion of the drillstring where it is located, and thus normally will be near the drill bit. The bit conventionally located in a drilling head or sub that is driven by drillstring rotation or by a drilling motor in the drilling sub. The alternator stator is an annular permanent magnet structure which surrounds the drilling axis, and which may include two sets of rare earth disc magnets spaced axially to form an axial gap, with the counterweight holding the magnets stationery with respect to the alternator coils. The coil structure is also annular and also surrounds the drilling axis, with the coil structure preferably including two sets of offset coils positioned to rotate in the gap between the permanent magnets. The two sets of coils make up a two-phase system; if desired, a single set of coils may be used to provide a single-phase system.

BRIEF DESCRIPTION OF DRAWINGS

The objects, features and advantages of the present invention will become apparent to those of skill in the art from the following detailed description of preferred embodiments thereof, taken with the accompanying drawings, in which.

DETAILED DESCRIPTION OF INVENTION

Figure 1:
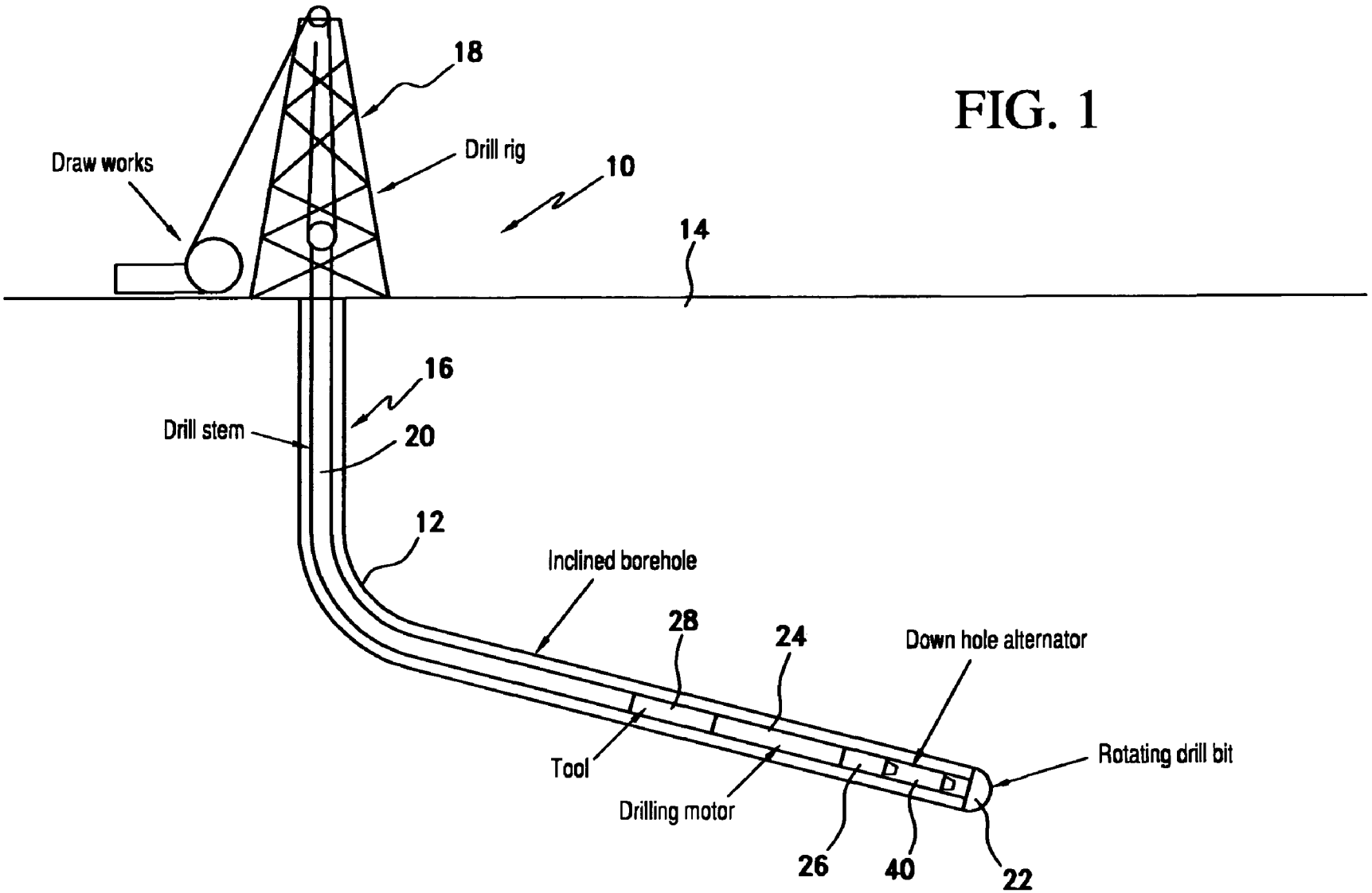
FIG. 1 is a diagrammatic illustration of a system for drilling a borehole.
Figure 2:
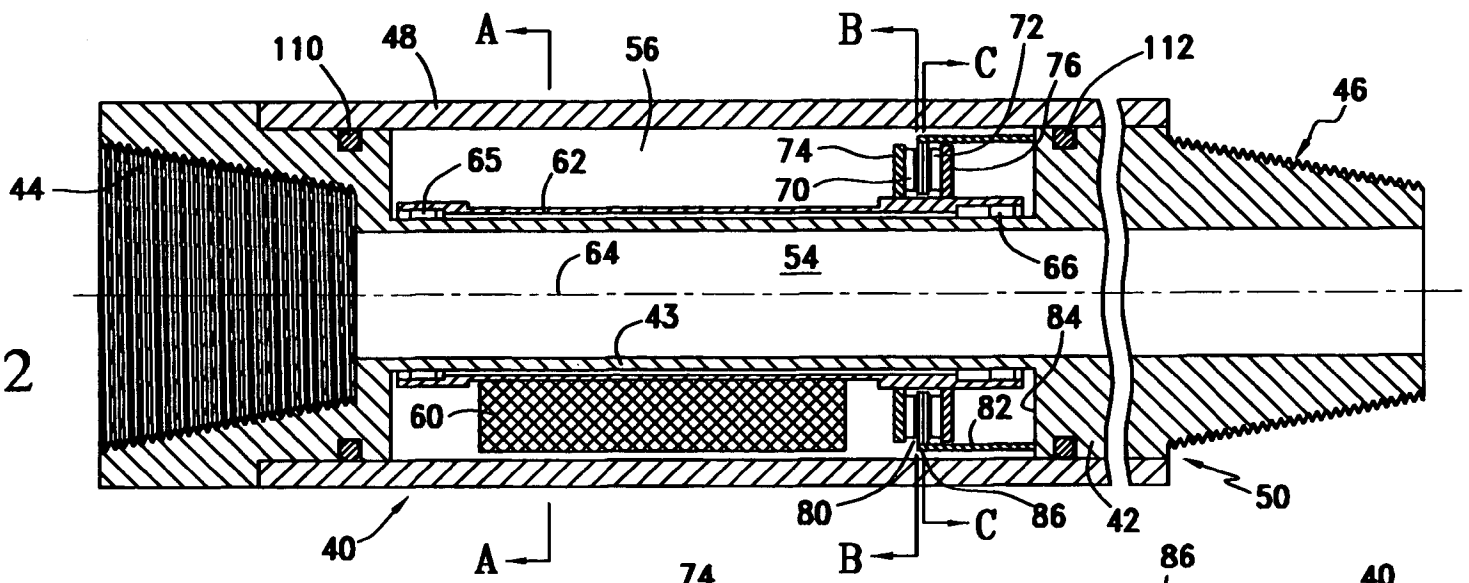
FIG. 2 is a cross-sectional crew of an alternator in accordance with the invention that is usable in the system of FIG. 1.
Figure 5:
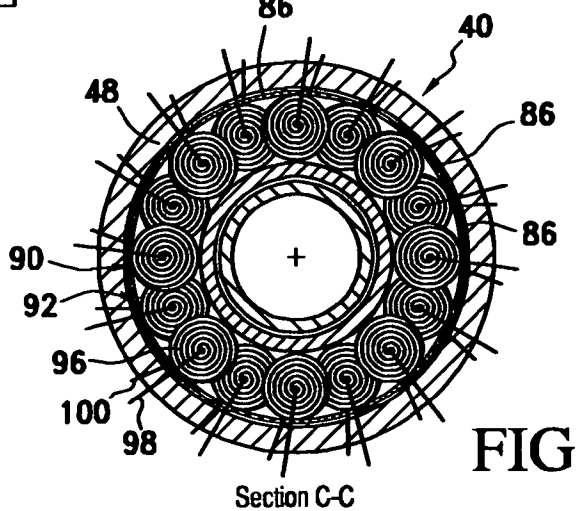
FIG. 5 is a cross-sectional view taken at lines C-C of FIG. 2, illustrating one set of rotor coils for the alternator of the present invention.

Turning now to a more detailed description of the invention, FIG. 1 illustrates a typical drilling system 10 for producing a borehole or well 12 in the earth 14. In the illustration, the borehole 12 includes an initial vertical portion 16 leading to an inclined portion 18 as would typically be found in a directional borehole. The drilling operation is initiated and controlled at a drill rig 18 on the earth's surface, where suitable drilling controls (not shown) are provided for regulating the operation of the drill. Typically, the drill rig supports a drillstring, or drillstem 20 which incorporates a rotating drill bit 22 at its distal end. The drill bit may be driven by rotation of the drillstring 20 by a drive motor at the drill rig 18, or may be driven by a downhole drilling motor 24 connected to the drill bit by a drilling sub 26 in known manner. A conventional drilling tool 28 is incorporated in the drillstring to provide the downhole instrumentation needed to detect the location of the drill bit and its direction of drilling, to provide control signals to the drilling motor, to detect conditions in the borehole, and to communicate with the drill controls at the surface.

In accordance with the invention, power is supplied to the tool 28 by means of a downhole alternator 40, illustrated in greater detail in FIGS. 2-6, to which reference is now made. The alternator includes a cylindrical body portion 42 having an inner cylindrical wall 43, first and second threaded ends 44 and 46, and a surrounding cylindrical sleeve 48 assembled to form an alternator housing 50 that preferably is part of the rotary drilling sub 26 that connects the drilling motor 24 to the drill bit 22. The threaded ends 44 and 46 of the alternator housing engage corresponding ends of the drilling sub so that the housing 50 is coaxial with, and rotates with, the drilling sub. Alternatively, one end of the housing 50 may be connected to a rotary drill stem for rotation with the stem 20.

The cylindrical inner housing wall 43 provides an axial passageway 54 through the length of the alternator to provide an unobstructed flow path for drilling fluid that flows down the drillstring to the drill bit. The wall 43 is spaced radially inwardly from sleeve 48 and is coaxial to provide an annular chamber 56 in which the alternator components are mounted.

Figure 3:
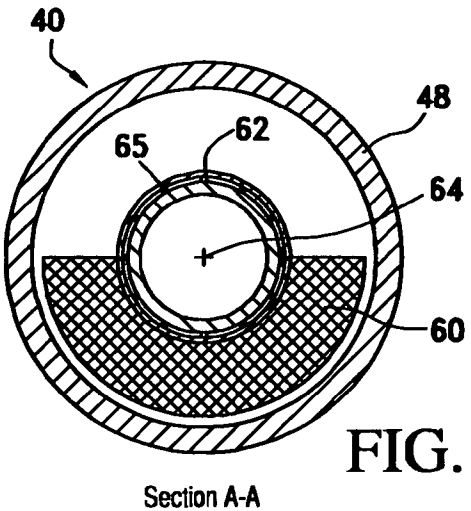
FIG. 3 is a cross-sectional view taken at lines A-A of FIG. 2, illustrating the stator counterweight of the present invention.

The alternator incorporates a semicylindrical counterweight 60 that is mounted on a cylindrical stator 62 which surrounds, and is spaced from, the inner housing wall 43 and is mounted for relative rotation with respect to the wall, and thus with respect to the alternator housing 50. Bearings 65 and 66 support the opposite ends of the stator 62 on the housing wall portion 43 to allow relative rotation. The counterweight 60 preferably is of lead, and is of sufficient axial length, radial thickness, and arcuate length around the axis 64 of the alternator to ensure that it remains on the low side of the inclined borehole as the sub and the housing rotate with the drive motor or with the drillstring. As illustrated in FIG. 3, the counterweight may extend arcuately halfway around the inner wall of the housing, but this arcuate length may vary in accordance with the weight needed to generate the desired amount of output current.

Figure 4:
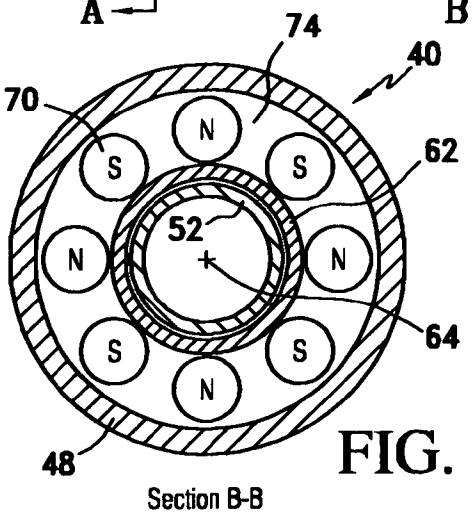
FIG. 4 is a cross-sectional view taken at lines B-B of FIG. 2, illustrating the stator permanent magnets.
Figure 6:
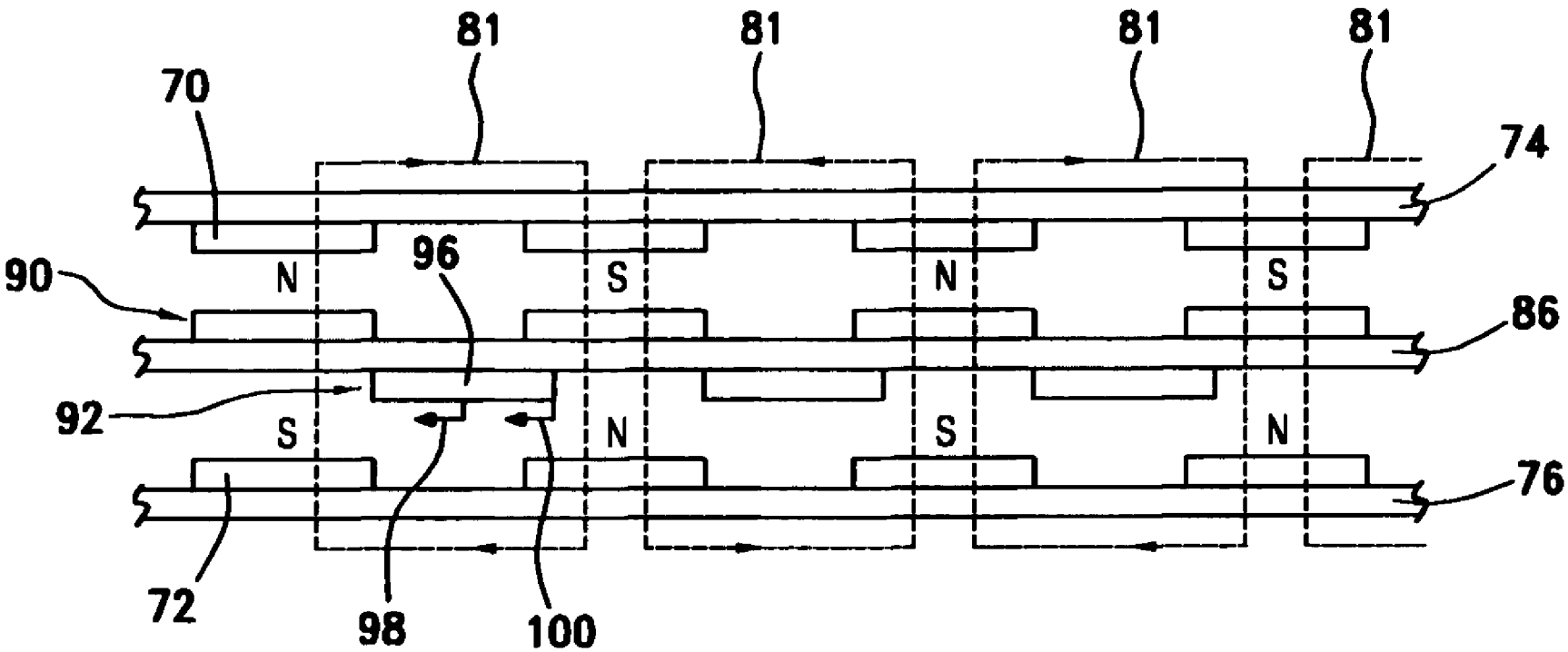
FIG. 6 is a diagrammatic illustration of the relationship of the permanent magnets on the stator to the coils on the rotor of the alternator of FIG. 2.

Also mounted on the stator 62, preferably near one end of it, are a multiplicity of sets of permanent magnets 70 and 72 for use in generating an output current. As illustrated, the permanent magnet sets 70 and 72 may be rare earth disc magnets secured to opposing surfaces of a pair of radially outwardly-extending, thin annular discs or plates 74 and 76, respectively, secured to the stator 62 and thus to the counterweight 60. As illustrated in FIGS. 4 and 6, the plate 74 carries a plurality of disc-type permanent magnets 70, spaced around the annular plate, and having alternate north and south polarities. Plate 76 is similar, and carries permanent magnet 72 spaced around the annular plate, and having alternate north and south polarities. The opposed magnets of sets 70 and 72 on plates 74 and 76 are of opposite polarity and are spaced apart axially to provide an axial gap 80. These opposed magnets provide magnetic flux lines 81 (FIG. 6) across the gap, in conventional manner. The counterweight holds the stator relatively stationary with respect to the surrounding housing 50.

An annular rotor 82 is secured to the housing 50, for example to an end wall 84 of the annular chamber 56, for rotation with the housing, and thus for relative rotation with respect to the stator and counterweight. The rotor includes a radially inwardly-extending annular coil support disc 86 which extends into the gap 80 between stator magnets 70 and 72, and which carries, in the preferred form of the invention, two offset layers 90 and 92 of flat, or "pancake" coils. Each layer includes a plurality of individual spirally-wound pancake coils such as the coil 96, with each coil having an inner lead 98 from the center of the coil and an outer lead 100 from the outer edge of the coil. In the preferred form of the invention the individual coils of layer 90 are interconnected to form a first output current having a first phase, while the individual coils of layer 92 are interconnected to form a second output current having a second phase, as rotation of housing 50 causes the rotor to spin the coils through the gap 80 between the relatively stationery permanent magnets on the stator. The output leads from the coils are connected to the downhole drilling tool 28 to provide two phase electrical power.

In the preferred form of the invention, the coils of layer 90 are connected in series so that the voltage generated by each coil is additive to produce the output voltage of phase 1. Similarly, the coils of layer 92 are connected in series to produce the output voltage of phase 2.

The counterweight 60 is suspended on the bearings 64, 66 for free rotation within cavity 56 about the inner wall portion 43, so that as the drillstring travels through the earth (in a non-vertical direction) the counterweight remains on the low side of the borehole. The cavity 56 is sealed by O-ring seals 110 and 112 so that the drilling fluid, flowing down through the center of the drillstring and back to the surface around the outside of the drillstring, does not interfere with the operation of the alternator, even as the alternator housing 50 rotates to produce relative rotation between the spaced stator permanent magnet sets 70 and 72 and the rotor coil sets 90 and 92 located in the gap 80. The lead counterweight, in one embodiment of the invention, was 12 inches long, with a six-inch outer diameter and a 3-inch inner diameter and extending 180 degrees around the axis, as illustrated in FIG. 3. At a drilling speed of 200 RPM, this weight was sufficient to generate about 230 watts of power when the borehole was horizontal, an amount more than sufficient to power the downhole drilling and telemetry circuitry. Although the available output from the alternator will vary with the inclination of the borehole being drilled, even with a 30□ inclination from the vertical, there would be only a 50% reduction in the torque available from the counterweight, and the output power would still be 115 watts. This is ample, for as little as 5 watts is sufficient for many downhole applications. In contrast, a 2 amp-hour battery pack having a 60-watt capacity producing 5 watts would run down in only 12 hours.

It is noted that the coil sets 90 and 92 preferably do not utilize iron cores in order to reduce the start-up torque of the alternator; air core coils produce insignificant induced magnetism so they will not drag the permanent magnets and the counterweight with them as the housing is rotated. However, if an excessive amount of current is drawn from the coils, the counterweight can be carried around the axis, and this limits the available alternator output power. This limit can be increased by using a larger counterweight. Alternatively, additional electrical capacity can be obtained by using multiple alternators along the axis of the drillstring.

The twisting force for generating the needed electrical power is derived from either the downhole drilling motor 24, which may be driven by the drilling fluid in conventional manner, or from rotation of the drillstring by surface motors at the drillrig 18, and this mechanical force is carried by the outer sleeve 48, which is secured to the body portion 42 by any suitable means, such as bolts, welding, structural adhesives, or the like. The alternator stator is isolated from the mechanical drilling stresses, with the O-rings 110 and 112 permanently sealing the interior cavity 56.

The coils 96 in the coil sets 90 and 92 are flat, wound coils, and are potted in epoxy for protection. The two-phase connection discussed above is preferred, not only because it provides a smoother torque, and because the overlapping structure (illustrated in FIGS. 5 and 6) provides more copper in the gap between the opposed magnets to provide more output power, but also because this provides a more convenient arrangement for connecting the return wires leading from the centers of the coils.

Although the invention has been described in terms of preferred embodiments, it will be understood that modifications and variations may be made without departing from the true spirit and scope thereof, as described in the following claims.

What is claimed is:

1. A drillstring alternator, comprising:

an alternator housing coupled to a rotary portion of a drillstring for rotation therewith;

a rotor mounted to said housing for rotation therewith, said rotor carrying at least one coil; and a stator mounted in said housing adjacent said rotor for relative rotation with respect to said rotor, said stator carrying at least one permanent magnet, whereby rotation of said housing produces relative rotation between said rotor and said stator to generate an electrical output from said stator coil.

2. The alternator of claim 1, wherein said stator incorporates a counterweight.

3. The alternator of claim 1, wherein said rotor incorporates an annular, radially inwardly-extending disc mounted to said housing, and wherein said at least one coil comprises multiple coils spaced around said rotor disc.

4. The alternator of claim 1, wherein said stator comprises a radially outwardly-extending annular plate, and wherein said at least one permanent magnet comprises multiple disc magnets spaced around said plate.

5. The alternator of claim 4, wherein said stator comprises a pair of axially spaced radially outwardly-extending annular plates each carrying a set of permanent magnets, the sets of magnets being opposed and defining a gap therebetween.

6. The alternator of claim 5, wherein said rotor incorporates an annular, radially inwardly-extending disc mounted to said housing and extending into said gap, and wherein said at least one coil comprises at least one set of coils spaced around said disc so as to pass through said gap between opposed permanent magnets.

7. The alternator of claim 6, wherein said rotor disc carries two sets of coils.

8. A drillstring alternator, comprising:

an alternator housing having an inner annular wall and a coaxial, surrounding annular sleeve forming an annular chamber;

a rotor mounted to said housing and located in said chamber, said rotor comprising an annular disc carrying a set of coils spaced around the disc;

a stator mounted in said chamber, said stator comprising an annular disc carrying a set of permanent magnets; and a counterweight located in said chamber and coupled to said stator to produce relative rotation between said stator and said rotor upon rotation of said housing.

9. The alternator of claim 8, wherein said rotor and said stator are coaxial with said housing.

10. The alternator of claim 9, wherein said stator is mounted on said inner annular wall for rotation with respect to said housing, whereby rotation of said housing produces relative rotation between said rotor coils and said stator permanent magnets to produce an alternating current output from said coils.

11. The alternator of claim 10, wherein said stator comprises a pair of annular discs, each carrying a corresponding set of permanent magnets, said stator discs being axially spaced to produce a gap, and wherein said rotor disc is mounted in said gap.

* * * * *